US009462834B2

(12) United States Patent
Galluzzo et al.

(10) Patent No.: US 9,462,834 B2
(45) Date of Patent: Oct. 11, 2016

(54) HOODED GARMENT WITH INTEGRATED PERIPHERAL VISION

(71) Applicant: Stahls' SCS, St. Clair Shores, MI (US)

(72) Inventors: George Galluzzo, Brampton (CA); Paul Regan, Brampton (CA); Randle Strong, Mississauga (CA)

(73) Assignee: Myogrid LP (CA)

( * ) Notice: Subject to any disclaimer, the term of this patent is extended or adjusted under 35 U.S.C. 154(b) by 117 days.

(21) Appl. No.: 14/290,589

(22) Filed: May 29, 2014

(65) Prior Publication Data

US 2014/0352027 A1 Dec. 4, 2014

Related U.S. Application Data

(60) Provisional application No. 61/828,254, filed on May 29, 2013.

(51) Int. Cl.
*A41D 3/00* (2006.01)

(52) U.S. Cl.
CPC ..... *A41D 3/00* (2013.01); *A41D 2200/20* (2013.01)

(58) Field of Classification Search
CPC ..... A41D 3/00; A41D 2200/20
See application file for complete search history.

(56) References Cited

U.S. PATENT DOCUMENTS

| | | | | | |
|---|---|---|---|---|---|
| 1,972,585 | A * | 9/1934 | Arst | A41D 3/08 | 2/84 |
| 2,601,680 | A * | 7/1952 | Shaw | A42B 1/045 | 2/10 |
| 3,676,879 | A * | 7/1972 | Irie | A42B 1/045 | 2/202 |
| 5,109,549 | A * | 5/1992 | Mattinson | A41D 31/0022 | 2/202 |
| 2014/0237705 | A1* | 8/2014 | Cominsky | A42B 1/04 | 2/410 |

FOREIGN PATENT DOCUMENTS

| | | | | |
|---|---|---|---|---|
| CA | 2449929 | A1 * | 1/2005 | A41D 27/18 |
| DE | 102008035683 | A1 * | 2/2010 | A41D 13/1153 |
| FR | EP 1262113 | A1 * | 12/2002 | A41D 3/00 |
| FR | 2891996 | A1 * | 4/2007 | A42B 1/048 |

* cited by examiner

*Primary Examiner* — Shaun R Hurley
*Assistant Examiner* — Andrew W Sutton
(74) *Attorney, Agent, or Firm* — Fishman Stewart PLLC

(57) ABSTRACT

Exemplary garments and methods of making the same are disclosed. An exemplary garment may include a body, and a hood extending from an upper portion of the body to provide an enclosure. The hood may include a main portion and at least one laterally disposed portion having a greater transparency than the main portion. An exemplary method of making a garment may include providing a body, and forming a hood extending from an upper portion of the body to provide an enclosure, with the hood including a main portion and at least one laterally disposed portion. The method may further include establishing the at least one laterally disposed portion as having a greater transparency than the main portion.

18 Claims, 5 Drawing Sheets

HOODED GARMENT WITH INTEGRATED PERIPHERAL VISION

CROSS-REFERENCE TO RELATED APPLICATIONS

This application claims priority to U.S. Provisional Application Ser. No. 61/828,254, filed on May 29, 2013, the contents of which are hereby expressly incorporated by reference in its entirety.

BACKGROUND

Hooded garments generally may provide a hood enclosure which allows a wearer of the garment to selectively cover or enclose their head, e.g., to protect from the elements such as rain or sun. Known hooded garments typically employ fabrics or other material which by their nature are not transparent. Indeed, the purpose of such garments is typically to protect from outer elements, provide cover, and also provide a desired look or style. For example, hooded garments are usually colored or have graphics or other styling. Additionally, since hooded garments usually enclose a wearer's head entirely or substantially so, the wearer's field of vision is often restricted by the hood when it is deployed over the wearer's head. While the wearer may desire the protection afforded by the hood enclosure, the hood enclosure restricts the wearer's field of vision. As hooded garments have become more popular in athletic or sports training wear, the restricted field of vision has become particularly disadvantageous. The restricted field of view of the wearer with the hood deployed may result in possible discomfort or an increased safety risk.

Accordingly, there is a need for an improved hooded garment that addresses the above disadvantages.

BRIEF DESCRIPTION OF THE DRAWINGS

While the claims are not limited to the illustrated embodiments, an appreciation of various aspects is best gained through a discussion of various examples thereof. Referring now to the drawings, illustrative embodiments are shown in detail. Although the drawings represent the embodiments, the drawings are not necessarily to scale and certain features may be exaggerated to better illustrate and explain an innovative aspect of an embodiment. Further, the embodiments described herein are not intended to be exhaustive or otherwise limiting or restricting to the precise form and configuration shown in the drawings and disclosed in the following detailed description. Exemplary embodiments of the present invention are described in detail by referring to the drawings as follows.

DETAILED DESCRIPTION

Figure 1:
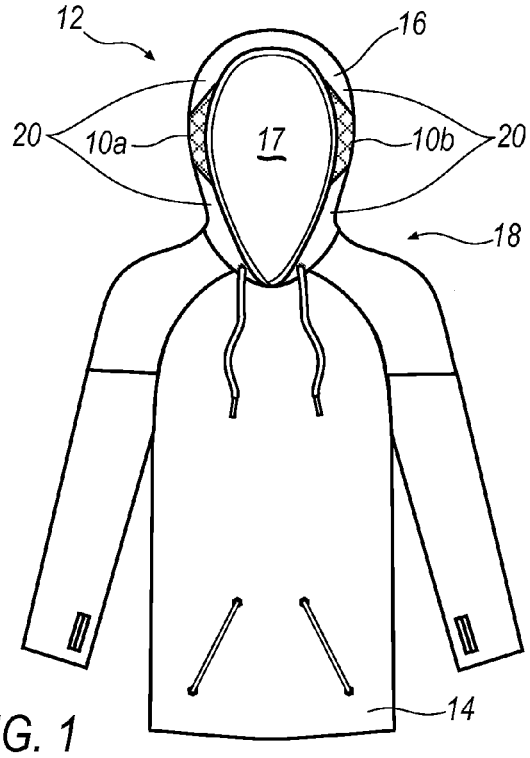
FIG. 1 is a front view of an exemplary hooded garment.
Figure 2:
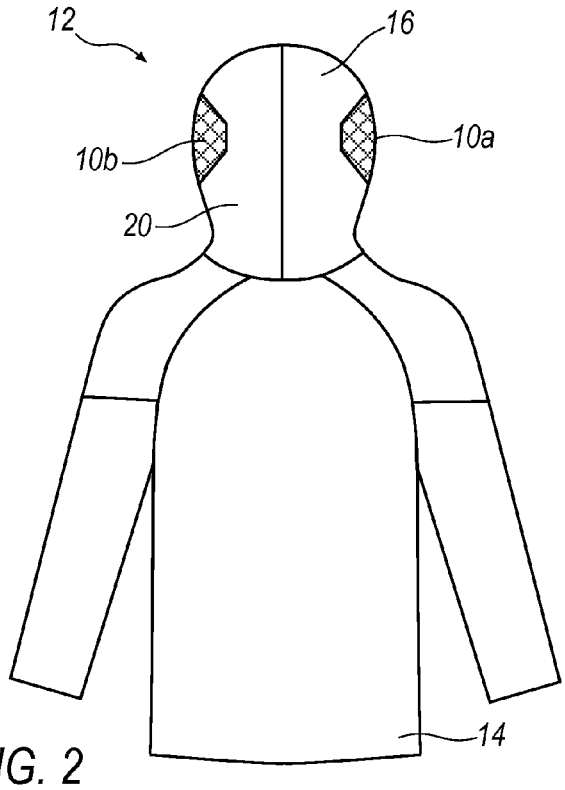
FIG. 2 is a rear view of the exemplary hooded garment of FIG. 1.

Referring now to the drawings, illustrative embodiments are shown in detail. Although the drawings represent the embodiments, the drawings are not necessarily to scale and certain features may be exaggerated to better illustrate and explain an innovative aspect of an embodiment. Further, the embodiments described herein are not intended to be exhaustive or otherwise limit or restrict the invention to the precise form and configuration shown in the drawings and disclosed in the following detailed description.

Turning now to FIGS. 1, 2, 3A, and 3B, an exemplary hooded garment 12 is illustrated. The garment 12 includes a body 14 and a hood 16. While the garment 12 is illustrated as a pullover-style garment with long sleeves, i.e., which extend to a position proximate the wrists of the wearer, any other style of hooded garment may be employed, including but not limited to short sleeve or sleeveless garments. Additionally, exemplary garments may be have full or partial openings allowing for selective closure with zippers or buttons, e.g., a standard torso zipper profile, in full or quarter-zip configurations, merely as examples.

The hood 16 extends from an upper portion 18 of the body 12 to generally provide an enclosure 17, as best seen in FIG. 1. The enclosure 17 provided by the hood 16 generally allows a wearer of the garment 12 to selectively cover the wearer's head. The overall fitting profile of the garment can be any that is convenient, i.e., the garment 12 may be tight, fitted, regular or loose.

The hood 16 includes a main portion 20 and at least one laterally disposed portion 10. The main portion 20 may generally provide cover from the elements such as sun, rain, wind, etc. Moreover, the main portion 20 may be opaque. In some examples, the main portion 20 is colored or has graphics or other styling features. In the exemplary approach shown in FIGS. 1-3, the hood 16 includes two laterally disposed portions 10*a*, 10*b* which are positioned on opposite sides of the hood 16. The laterally disposed portion(s) 10 may have a greater transparency than the main portion 20. Accordingly, a wearer of the garment may generally see through the laterally disposed portions 10, at least to a greater extent than through the main portion 20.

The laterally disposed portions 10 may be positioned at or around an eye level of the wearer when the hood 16 is deployed. In this manner, the wearer's field of vision is enhanced by the ability to see through the laterally disposed portions 10, at least to a greater degree than afforded by the material of the main portion 20 of the hood 16.

Figure 3A:
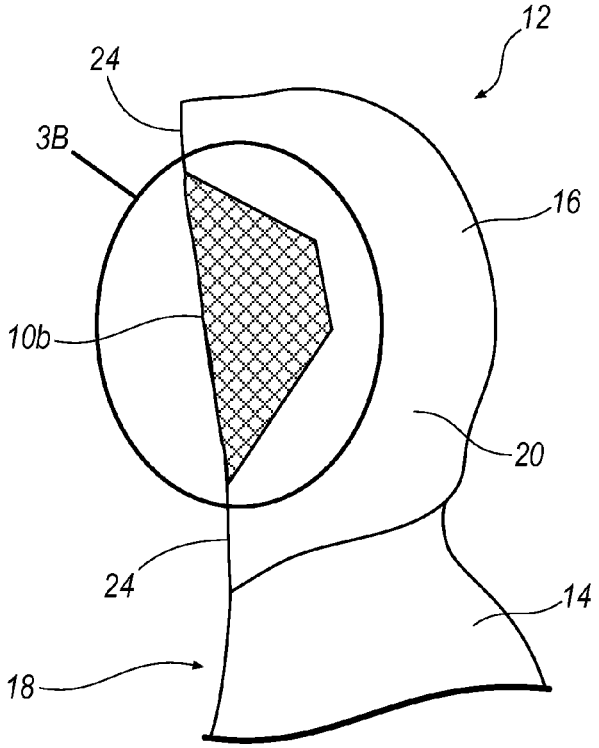
FIG. 3A is an enlarged side view of the exemplary hooded garment of FIGS. 1 and 2.
Figure 3B:
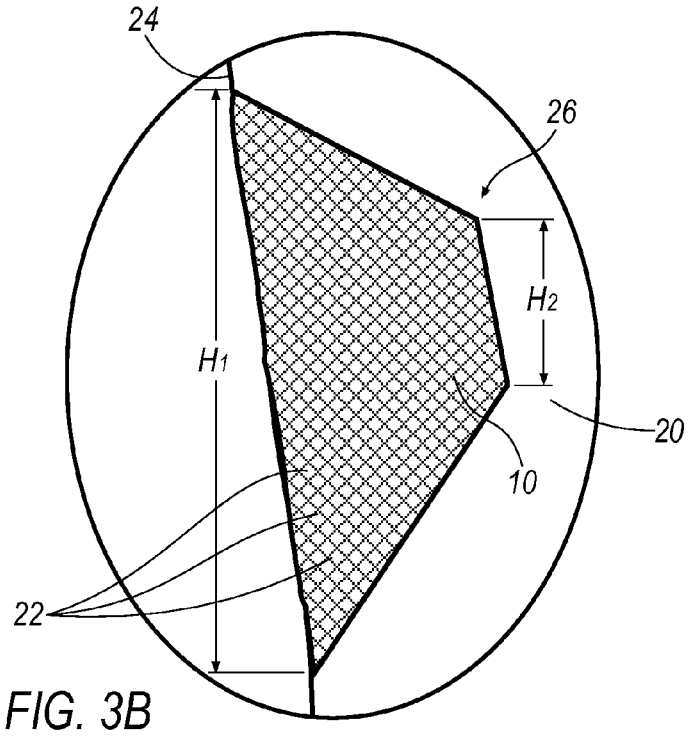
FIG. 3B is an enlarged view of detail 3B of FIG. 3A.

As best seen in FIGS. 3A and 3B, the laterally disposed portions 10 may be positioned along a forward edge 24 of the hood 16. In this manner, the relative transparency provided by the laterally disposed portions 10 is positioned as forwardly as possible relative to the wearer, to maximize the enhanced peripheral vision. Additionally, in the examples shown in FIGS. 3A and 3B, the laterally disposed portions 10 are illustrated having a maximum height $H_1$ along the forward edge 24, which narrows to a smaller height $H_2$ at a rearward end 26 of the laterally disposed portions 10. This exemplary shape may reduce an overall size of the laterally disposed portions 10, while maximizing the field of view, especially vertically upwards and downwards from the position of the wearer's eyes (not shown in FIGS. 3A and 3B).

The laterally disposed portions 10 may generally allow some transparency from within the enclosure 17 of the hood 16 outwardly, without allowing significant view into interior of hood, and also without destroying the structure of the hood 16 or the ability of the hood 16 to protect the wearer. In one exemplary approach, the laterally disposed portions 10 have a mesh pattern or material defining a plurality of apertures 22, as best seen in FIG. 3B. For example, a mesh pattern or material may have apertures 22 as a result of a woven material defining the mesh pattern, or as a result of material being removed to define the apertures 22. The mesh may be a generally fine mesh pattern, as further described below. In one example, the laterally disposed portions 10 allow a wearer to generally see out through the laterally disposed portions 10, while restricting others from seeing through the laterally disposed portions 10 from outside the hood into the interior of the hood enclosure.

Any pattern or mesh material may be used to define the laterally disposed portions 10. The laterally disposed portions 10 need only create enough transparency to increase peripheral vision when wearing the hooded pullover, i.e., by allowing at least some ability to see through the laterally disposed portions 10. In one exemplary illustration, a fine mesh material is employed where the apertures 22 comprise approximately 50% of the surface area of the laterally disposed portions 10. Moreover, any other mesh density or relative transparency of the laterally disposed portions 10 may be employed that is convenient.

The laterally disposed portions 10 can be integrated with the main portion 20 of the hood in any manner that is convenient. In one example, the laterally disposed portions 10 may be integrated with the main portion 20 of the hood 16 such that the main portion 20 and one or both of the laterally disposed portions 10 are formed of a single monolithic piece. For example, a seamless circular or warp knitted construction may be used, such that the targeted mesh jacquard is integrated seamlessly with the main portion 20 of the hood 16 portion of the garment 12. In another example, a material removal or cutting process such as a laser cutting process may be employed to form apertures in the hood 16, thereby creating a mesh or aperture pattern in the laterally disposed portions 10 of the hood 16.

In other exemplary approaches, the laterally disposed portions 10 are formed separately and later joined to the main portion 20 of the hood. For example, a "Cut n'sew" pullover construction may be employed, whereby the laterally disposed portions 10 are formed separately from the main portion 20, and are subsequently sewn to the main portion 20 of the hood 16. In another exemplary illustration, a separately formed laterally disposed portion 10 may be glued, bonded or welded to the main portion 20 of the hood 16.

The materials used for the garment 12, including hood 16 and portions thereof such as the main portion 20 and laterally disposed portions 10 may be any that is convenient. In one example, any synthetic or natural fibers may be used, e.g., nylon, polyester, spandex, or any blends thereof. In another example, a fleece material may be employed.

Turning now to FIGS. 5, 6, 7A, and 7B, front, back, and various side views of an exemplary design for a hooded garment are illustrated.

Figure 4:
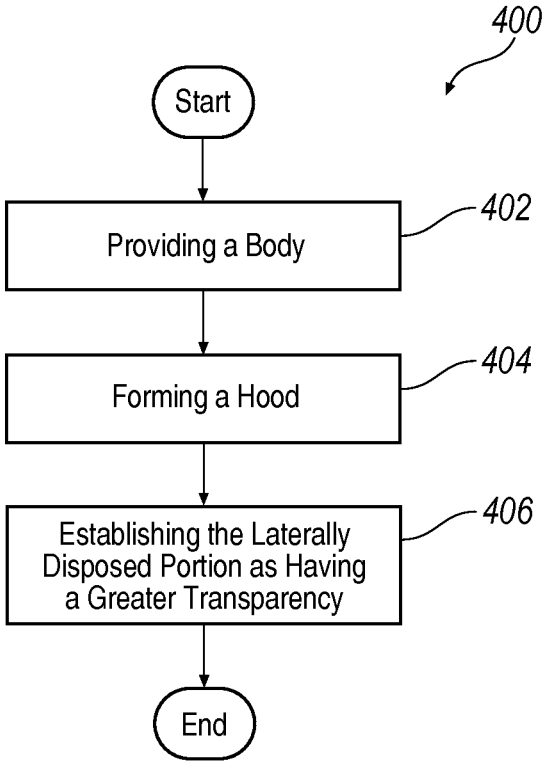
FIG. 4 is an exemplary process flow diagram for an exemplary method of making a garment.
Figure 5:
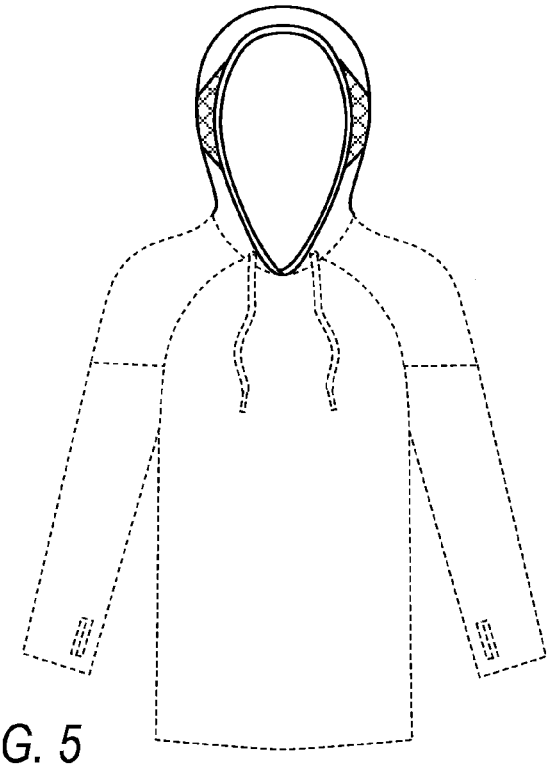
FIG. 5 is a front view of an exemplary design for a hooded garment.
Figure 6:
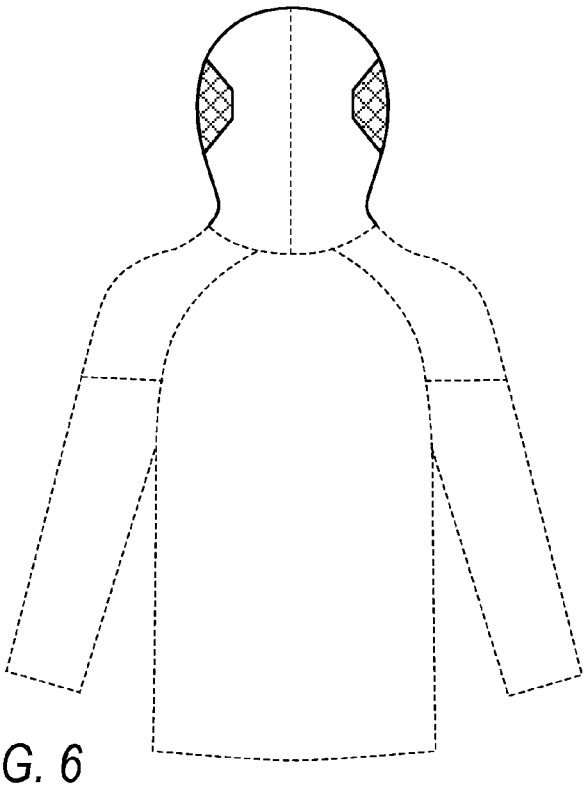
FIG. 6 is a rear view of the exemplary design of FIG. 5 for a hooded garment.
Figure 7A:
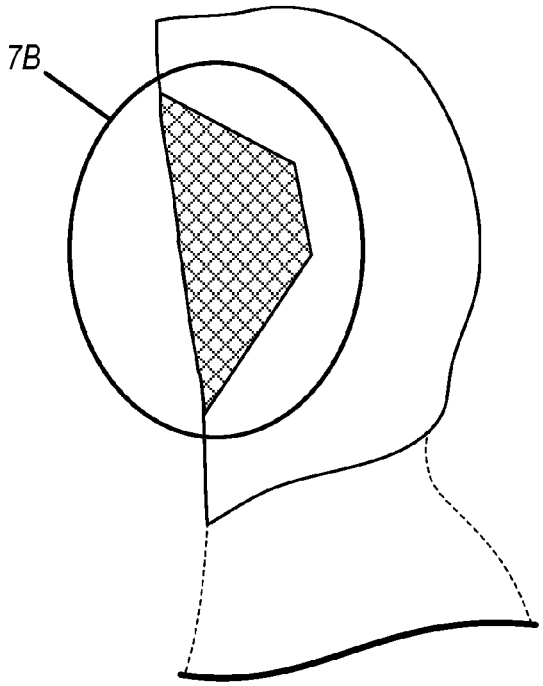
FIG. 7A is a side view of the exemplary design of FIGS. 5 and 6 for a hooded garment.
Figure 7B:
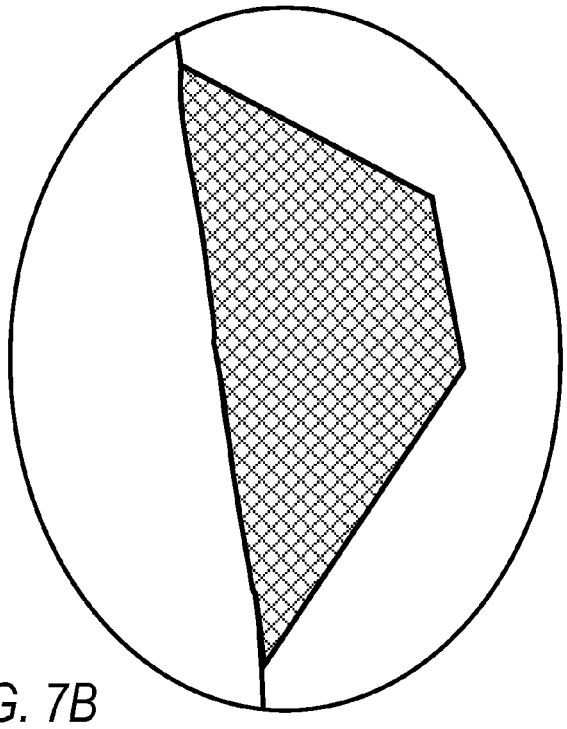
FIG. 7B is an enlarged view of detail 7A from FIG. 7A, of the exemplary design of FIGS. 5, 6, and 7A for a hooded garment.

Turning now to FIG. 4, an exemplary process 400 for making a garment is described. Process 400 may begin at block 402, where a body is provided. For example, a body 14 of a garment may be provided, e.g., by forming in any material forming process that is convenient.

Proceeding to block 404, a hood may be formed that extends from an upper portion of the body to provide an enclosure. For example, as described above a hood 16 may include a main portion 20 and at least one laterally disposed portion 10. The body 14, hood 16, and portions thereof such as the main portion 20 and laterally disposed portion(s) 10 may be formed integrally or separately, as noted above. More specifically, the laterally disposed portion(s) 10 may be formed integrally as a single monolithic piece with the main portion 20, e.g., in a seamless forming process in a cutting process, e.g., laser cutting, where material is removed to form apertures 22 therein. In other exemplary approaches, the laterally disposed portion(s) 10 may be formed as a separate piece(s) from the main portion 20, and may be sewn or bonded to the main portion 20. Process 400 may then proceed to block 406.

At block 406, the at least one laterally disposed portion is established as having a greater transparency than the main portion. For example, as described above a wearer of the garment may generally see through the laterally disposed portions 10, at least to a greater extent than through the main portion 20.

In some exemplary approaches, the exemplary methods described herein may employ a computer or a computer readable storage medium implementing the various methods and processes described herein, e.g., process 400. In general, computing systems and/or devices, such as any processor(s) and/or microprocessors used to execute exemplary methods described herein, merely as examples, may employ any of a number of computer operating systems, including, but by no means limited to, versions and/or varieties of the Microsoft Windows® operating system, the Unix operating system (e.g., the Solaris® operating system distributed by Oracle Corporation of Redwood Shores, Calif.), the AIX UNIX operating system distributed by International Business Machines of Armonk, N.Y., the Linux operating system, the Mac OS X and iOS operating systems distributed by Apple Inc. of Cupertino, Calif., and the Android operating system developed by the Open Handset Alliance.

Computing devices generally include computer-executable instructions, where the instructions may be executable by one or more computing devices such as those listed above. Computer-executable instructions may be compiled or interpreted from computer programs created using a variety of programming languages and/or technologies, including, without limitation, and either alone or in combination, Java™, C, C++, Visual Basic, Java Script, Perl, etc. In general, a processor (e.g., a microprocessor) receives instructions, e.g., from a memory, a computer-readable medium, etc., and executes these instructions, thereby performing one or more processes, including one or more of the processes described herein. Such instructions and other data may be stored and transmitted using a variety of computer-readable media.

A computer-readable medium (also referred to as a processor-readable medium) includes any non-transitory (e.g., tangible) medium that participates in providing data (e.g., instructions) that may be read by a computer (e.g., by a processor of a computer). Such a medium may take many forms, including, but not limited to, non-volatile media and volatile media. Non-volatile media may include, for example, optical or magnetic disks and other persistent memory. Volatile media may include, for example, dynamic random access memory (DRAM), which typically constitutes a main memory. Such instructions may be transmitted by one or more transmission media, including coaxial cables, copper wire and fiber optics, including the wires that comprise a system bus coupled to a processor of a computer. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, any other memory chip or cartridge, or any other medium from which a computer can read.

Databases, data repositories or other data stores described herein may include various kinds of mechanisms for storing, accessing, and retrieving various kinds of data, including a hierarchical database, a set of files in a file system, an application database in a proprietary format, a relational database management system (RDBMS), etc. Each such data store is generally included within a computing device employing a computer operating system such as one of those mentioned above, and are accessed via a network in any one or more of a variety of manners. A file system may be accessible from a computer operating system, and may include files stored in various formats. An RDBMS generally employs the Structured Query Language (SQL) in addition to a language for creating, storing, editing, and executing stored procedures, such as the PL/SQL language mentioned above.

In some examples, system elements may be implemented as computer-readable instructions (e.g., software) on one or more computing devices (e.g., servers, personal computers, etc.), stored on computer readable media associated therewith (e.g., disks, memories, etc.). A computer program product may comprise such instructions stored on computer readable media for carrying out the functions described herein.

The exemplary illustrations are not limited to the previously described examples. Rather, a plurality of variants and modifications are possible, which also make use of the ideas of the exemplary illustrations and therefore fall within the protective scope. Accordingly, it is to be understood that the above description is intended to be illustrative and not restrictive.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claimed invention.

Accordingly, it is to be understood that the above description is intended to be illustrative and not restrictive. Many embodiments and applications other than the examples provided would be upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In sum, it should be understood that the invention is capable of modification and variation and is limited only by the following claims.

All terms used in the claims are intended to be given their broadest reasonable constructions and their ordinary meanings as understood by those skilled in the art unless an explicit indication to the contrary in made herein. In particular, use of the singular articles such as "a," "the," etc. should be read to recite one or more of the indicated elements unless a claim recites an explicit limitation to the contrary.

What is claimed, is:

1. A garment, comprising:

a body; and a hood extending from an upper portion of the body to provide an enclosure, the hood including a main portion and at least one laterally disposed portion having a greater transparency than the main portion;

wherein the laterally disposed portion is formed integrally as a single monolithic piece with the main portion.

2. The garment of claim 1, wherein the laterally disposed portion is configured to allow a wearer of the garment to see through the laterally disposed portion.

3. The garment of claim 2, wherein the laterally disposed portion is configured to restrict visibility into an interior of the hood.

4. The garment of claim 1, wherein the laterally disposed portion is positioned along a forward edge of the hood.

5. The garment of claim 1, wherein the hood includes two laterally disposed portions, the two laterally disposed portions positioned on opposite sides of the hood.

6. The garment of claim 1, wherein the laterally disposed portion is positioned vertically at an eye level of the hood.

7. The garment of claim 1, wherein the laterally disposed portion includes a mesh.

8. The garment of claim 1, wherein the laterally disposed portion is formed as a separate piece from the main portion.

9. The garment of claim 8, wherein the laterally disposed portion is one of sewn and bonded to the main portion.

10. A garment, comprising:

a body; and a hood extending from an upper portion of the body to provide an enclosure, the hood including a main portion and two laterally disposed portions positioned on opposite sides of the hood, the two laterally disposed portions each having a greater transparency than the main portion, the two laterally disposed portions each positioned along a forward edge of the hood;

wherein the two laterally disposed portions are formed integrally as a single monolithic piece with the main portion.

11. A method of making a garment, comprising:

providing a body; and forming a hood extending from an upper portion of the body to provide an enclosure, including forming a main portion and forming at least one laterally disposed portion; and establishing the at least one laterally disposed portion as having a greater transparency than the main portion;

further comprising forming the laterally disposed portion integrally as a single monolithic piece with the main portion.

12. The method of claim 11, further comprising positioning the laterally disposed portion along a forward edge of the hood.

13. The method of claim 11, further comprising forming two laterally disposed portions and positioning the two laterally disposed portions on opposite sides of the hood.

14. The method of claim 11, further comprising establishing the laterally disposed portion as a mesh material.

15. The method of claim 11, further comprising forming the laterally disposed portion by laser cutting a plurality of apertures in a material of the hood.

16. The method of claim 11, further comprising forming the main portion and the laterally disposed portion seamlessly.

17. The method of claim 12, further comprising forming the laterally disposed portion as a separate piece from the main portion.

18. The method of claim 17, further comprising one of sewing and bonding the laterally disposed portion to the main portion.

* * * * *